US006663731B1

(12) United States Patent
Rose et al.

(10) Patent No.: US 6,663,731 B1
(45) Date of Patent: Dec. 16, 2003

(54) LEAD-FREE PYROTECHNIC COMPOSITION

(75) Inventors: James E. Rose, Bryans Road, MD (US); Douglas Elstrodt, Waldorf, MD (US); Jan A. Puszynski, Rapid City, SD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 25 days.

(21) Appl. No.: 10/094,810

(22) Filed: Mar. 12, 2002

(51) Int. Cl.[7] ..... C06B 33/06
(52) U.S. Cl. ..... 149/42
(58) Field of Search ..... 149/19.91, 87, 149/117, 37, 42; 102/334

(56) References Cited

U.S. PATENT DOCUMENTS

| | | | | | |
|---|---|---|---|---|---|
| 3,046,168 | A | * | 7/1962 | Burkardt et al. | 149/42 |
| 4,608,102 | A | | 8/1986 | Krampen et al. | 149/92 |
| 4,674,409 | A | | 6/1987 | Lopata et al. | 102/471 |
| 4,675,059 | A | | 6/1987 | Mei | 149/43 |
| 4,812,180 | A | | 3/1989 | Sayles | 149/19.5 |
| 4,841,865 | A | * | 6/1989 | Liberman | 102/334 |
| 5,353,707 | A | | 10/1994 | Duguet | 102/290 |
| 5,466,315 | A | | 11/1995 | Erickson et al. | 149/96 |
| 5,538,569 | A | | 7/1996 | Carter | 149/105 |
| 5,610,367 | A | | 3/1997 | Erickson et al. | 149/35 |
| 5,684,268 | A | | 11/1997 | Lopata | 149/39 |
| 5,831,208 | A | | 11/1998 | Erickson | 149/18 |
| 5,993,577 | A | | 11/1999 | Erickson et al. | 149/68 |
| 6,214,139 | B1 | * | 4/2001 | Hiskey et al. | 149/36 |

* cited by examiner

*Primary Examiner*—Michael J. Carone
*Assistant Examiner*—Aileen B. Felton
(74) *Attorney, Agent, or Firm*—Mark Homer

(57) ABSTRACT

The present invention is a lead-free pyrotechnic composition comprising from about 60 percent by weight to about 80 percent by weight iodine pentoxide and from about 15 percent by weight to about 35 percent by weight of a solid-powder fuel. The solid-powder fuel may normally be selected from aluminum, magnesium, or a combination thereof. Depending upon the potential use for the lead-free pyrotechnic composition of the present invention, the composition may also include from about 4 to 10 percent by weight of a stabilizer that neutralizes any iodic acid formed by the iodine pentoxide, from about 3 to 5 percent by weight of a binder, or from about 5 to 15 percent by weight of a coloring agent. In a preferred embodiment of the invention, the aluminum will comprise aluminum flake having a size ranging from about nanometers to about 100 nanometers.

17 Claims, No Drawings

LEAD-FREE PYROTECHNIC COMPOSITION

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The present invention pertains to the field of lead-free pyrotechnic compositions. More particularly, the invention pertains to non-toxic pyrotechnic compositions to replace lead-based pyrotechnic compositions that use substances such as lead styphnate or lead azide. The present invention may be used, for example, in ignition devices, to provide solid formulations for illumination devices such as flares or fireworks, or in warhead applications for military uses.

2. Brief Description of the Prior Art

For many years, primer compositions have included two sensitive explosive constituents together with oxidizers, binders/friction agents, and fuels. The most commonly used explosive constituents are lead styphnate coupled with tetracene. The most commonly used fuel is antimony sulphide. These constituents are used despite the fact that the by-products of firing such a composition result in highly toxic materials being released into the atmosphere such as lead and antimony. Such elements produce a potential health hazard, particularly within enclosed areas such as firing ranges where such elements can accumulate over time.

Because of the health problems associated with using such primer compositions, many compositions have been developed over the past twenty years attempting to produce a non-toxic alternative that still provides a non-corrosive material that functions as well as the lead-based primer compositions. Examples of such compositions can be found in U.S. Pat. Nos. 5,993,577; 5,610,367; 5,538,569; 5,684,268; 5,353,707; and a number of others. These patents disclose compositions that replace lead styphnate as the primary explosive with materials such as dinitrobenzofuroxan, diazodinitrophenol, or cupric azide. However, either due to the high production costs associated with these non-toxic compositions or problems associated with their performance as primers, none of these compositions have been commercially used as a substitute for the lead-based primers discussed above.

Based upon the problems described above, it would be desirable to provide a lead-free pyrotechnic composition to replace lead-based primers that is similar or lower in cost to such primers and provides similar or better performance. To provide a cost competitive replacement, it would be desirable to provide a lead-free pyrotechnic composition that could be used for pyrotechnic applications other than as a primer. Examples would be for illumination such as flares or fireworks or in warhead applications for military uses.

SUMMARY OF THE INVENTION

Accordingly, it is an object of this invention to provide a lead-free pyrotechnic composition that can be used as a substitute for lead-based primer compositions.

It is a further object of this invention to provide a lead-free pyrotechnic composition that is cost-competitive with lead-based primer compositions.

It is yet a further object of this invention to provide a lead-free pyrotechnic composition that may be used for pyrotechnic applications other than as a primer.

This invention accomplishes these objectives and other needs related to lead-free pyrotechnic compositions by providing a composition comprising from about 60 percent by weight to about 80 percent by weight iodine pentoxide and from about 15 percent by weight to about 35 percent by weight of a solid-powder fuel. The solid-powder fuel may normally be selected from aluminum, magnesium, or a combination thereof. Depending upon the potential use for the lead-free pyrotechnic composition of the present invention, the composition may also include from about 4 to 10 percent by weight of a stabilizer that neutralizes any iodic acid formed by the iodine pentoxide, from about 3 to 5 percent by weight of a binder, or from about 5 to 15 percent by weight of a coloring agent. In a preferred embodiment of the invention, the aluminum will comprise aluminum flake having a size ranging from about 20 nanometers to about 100 nanometers.

The present invention may be used for many applications including use in warheads, as a percussion primer, or for use as a pyrotechnic flare or other illumination device. The composition may be specifically designed for such uses as discussed below by one skilled in the art. Therefore, the versatility of the present invention should help to improve its cost-competitiveness versus currently used lead-based pyrotechnics.

DESCRIPTION OF THE PREFERRED EMBODIMENT

The present invention comprises a versatile, lead-free pyrotechnic composition that may be used for many pyrotechnic applications. While this invention can provide a lead-free replacement for lead styphnate based percussion primers, which has been the basis of much research as discussed above, the invention can also be used for such things as warhead applications and in illumination devices. This versatility helps make the present invention extremely attractive from a commercial use/manufacturing standpoint.

The invention comprises from about 60 percent by weight to about 80 percent by weight iodine pentoxide and from about 15 percent by weight to about 35 percent by weight of a solid-powder fuel. Therefore, the reaction products will be non-toxic. In this most general embodiment of the present invention, the composition may be used as an explosive in warheads for military applications. A preferred solid-powder fuel for warhead applications would be aluminum. In a preferred embodiment of the invention, the aluminum would be aluminum flake having a size of from about 20 nanometers to about 100 nanometers. One preferred embodiment of the invention for warhead applications comprises approximately 80 percent by weight iodine pentoxide and approximately 20 percent by weight of aluminum flake. In this embodiment, the iodine pentoxide would be about 20 to 200 mesh size and the aluminum flake would be about 20 to 40 nanometers in size. Preparation of the composition would be accomplished using normal warhead explosive mixing procedures that are known by those skilled in the art. Several hundred kilograms of the composition would be required for a normal sized warhead.

The present invention may also include from about 4 to about 10 percent by weight of a stabilizer to nuetralize iodic acid formed from any contact with water from the ambient surroundings. With the addition of the stabilizer, the composition may easily be used for either warhead applications or for percussion primer applications. The stabilizer may be any chemical capable of nuetralizing the iodic acid that will not interfere with the reaction of the oxidizer and fuel and may be selected by one skilled in the art. Preferred stabilizers include calcium carbonate, strontium carbonate and barium carbonate with the most preferred being calcium carbonate.

For warhead applications, one preferred embodiment of the invention that includes the stabilizer would be where the iodine pentoxide comprises approximately 75.2 percent by weight, the aluminum comprises approximately 20 percent by weight aluminum flake, and the stabilizer comprises approximately 4.8 percent by weight calcium carbonate.

For percussion primer applications, the preferred size of the iodine pentoxide comprises from about 20 microns or less. The preferred size of the aluminum flake size would still range from about 20 to 100 nanometers. For percussion primer applications, it would be preferred to include from about 3 to 5 percent by weight of a binder. Particular binders may be selected by one skilled in the art. Examples of such binders include gum arabic, Fluorel, Viton, or other high temperature stable polymers with gum arabic being the most preferred binder. One preferred embodiment of a percussion primer composition would be where the iodine pentoxide comprises approximately 71.5 percent by weight, the aluminum flake comprises approximately 19 percent by weight, the calcium carbonate comprises approximately 4.5 percent by weight, and the gum arabic comprises approximately 5 percent by weight.

For illumination producing applications such as flares or fireworks, the most general embodiment of the invention discussed above, from about 60 to 80 percent by weight iodine pentoxide and from about 15 to 35 percent by weight solid-powder fuel would be used. Preferably, these constituents would be combined with from about 5 to 15 percent by weight of a coloring agent. Preferred coloring agents would include calcium carbonate for orange color, strontium carbonate for red color, and barium carbonate for green color. In a preferred embodiment of a pyrotechnic flare composition, the ratio of the iodine pentoxide to the solid-powder fuel would be about 3 to 1. Preferred solid-powder fuels include magnesium and a mixture of magnesium and aluminum with a 50%/50% mixture being preferred. Aluminum may also be used. When using aluminum, an aluminum flake having a size of about 45 microns by 1 micron thick would be a preferred size. The mixing procedure for a pyrotechnic flare composition would be known by one skilled in the art. An example of a procedure to make the pyrotechnic flare composition includes screening the mixture 3 times through a 30 mesh sieve; dampen with alcohol; screening 3 more times through a 30 mesh sieve; ram the mixture into flare cases; and let dry 3 days.

The following examples illustrate certain preferred embodiments of the invention along with mixing procedures.

EXAMPLE 1

The following are the mixing procedures to produce an embodiment of the present invention having the composition:

| Ingredient | Weight Percent |
|---|---|
| Iodine Pentoxide | 71.5 |
| Aluminum Flake | 19 |
| Calcium Carbonate | 4.5 |
| Gum Arabic | 5 |

1. Dry toluene (or another suitable solvent for gum arabic) over molecular seives for 2–5 days to remove residual water. Decant off the dried toluene into a suitable storage container.
2. Place gum arabic into a conductive mixing bowl. Add 5 to 15 parts by weight of toluene to the mixing bowl.
3. Mix the gum arabic and toluene at 120–140° F. until all of the gum arabic disolves.
4. Add the calcium carbonate, iodine pentoxide, and aluminum flake to the mixing bowl. Mix under heat and/or vacuum until the level of the free solvent is approximately equal to the level of the solid ingredients. The mixture should appear as a thin paste. Note that leaving excess solvent at this point would leave unmixed gum arabic on the surface of the mixture during drying.
5. Spread the paste in a thin layer onto a conductive plastic sheet and place in an oven at 120–140° F. for 1–2 days to remove the solvent.
6. After drying, use a conductive plastic spatula to carefully break the material into a free flowing powder.
7. Carefully place the dry powder into a conductive plastic container and seal tightly for storage.

EXAMPLE 2

The following compositions are examples of embodiments of the invention for specific types of uses that can be prepared using similar mixing procedures as those above that can be amended by those skilled in the art for the particular embodiment:

Warhead Application

Example 1:

75.2% by weight iodine pentoxide (20–200 mesh size)

20% by weight flake aluminum (20–100 nanometers)

4.8% by weight calcium carbonate

Example 2:

80% by weight iodine pentoxide (20–200 mesh size)

20% by weight flake aluminum (20–40 nanometers)

Percussion Primer Application 71.5% by weight iodine pentoxide (20 microns or less)

19% by weight flake aluminum (20–100 nanometers)

4.5% by weight calcium carbonate

5% by weight gum arabic

Pyrotechnic Flare Application

69% by weight iodine pentoxide

23% by weight flake aluminum (45 micron by 1 micron thick)

8% by weight calcium carbonate

The following describes data from tests for two of the specific embodiments of the invention disclosed above related to impact, friction, ESD sensitivity, and onset of exotherm temperature.

Warhead Application (Example 1):

| Test | Sensitivity | RDX Standard |
|---|---|---|
| NOS Impact (50% height) (mm) | 217 | 247 |
| ABL Friction (psig) | <30 | 135 |
| ESD (joules) | 0.015 | 0.095 |

Percussion Primer Application:

| Test | Sensitivity | RDX Standard |
|---|---|---|
| NOS Impact (50% height) (mm) | 206 | 277 |
| ABL Friction (psig) (8 ft/s) | <30 | 135 |
| ABL Friction (psig) (3 ft/s) | <30 | 420 |
| ESD (joules) | 0.023 | 0.095 |
| DSC Onset Temperature (° C.) | 292 | |

As can be seen from these tables, for these particular applications the present invention significantly exceeds necessary current requirements.

What is described are specific examples of many possible variations on the same invention and are not intended in a limiting sense. The claimed invention can be practiced using other variations not specifically described above.

What is claimed is:

1. A lead-free pyrotechnic composition, comprising:

from about 60 percent by weight to about 80 percent by weight iodine pentoxide; and, from about 15 percent by weight to about 35 percent by weight of a solid-powder fuel selected from aluminum, magnesium, or a combination thereof, wherein the solid-powdered fuel comprises flake having a size of from about 20 nanometers to about 100 nanometers.

2. The lead-free pyrotechnic composition of claim 1, wherein the solid-powdered fuel comprises aluminum.

3. The lead-free pyrotechnic composition of claim 2, further comprising from about 4 percent by weight to about 10 percent by weight of a stabilizer to neutralize iodic acid formed from firing the composition.

4. The lead-free pyrotechnic composition of claim 3, further comprising from about 3 percent by weight to about 5 percent by weight of a binder.

5. The lead-free pyrotechnic composition of claim 4, wherein the stabilizer comprises calcium carbonate.

6. The lead-free pyrotechnic composition of claim 5, wherein the binder comprises gum arabic.

7. The lead free pyrotechnic composition of claim 6, wherein the iodine pentoxide comprises a size of about less than 20 microns.

8. The lead-free pyrotechnic composition of claim 7, wherein the iodine pentoxide comprises approximately 71.5 percent by weight, the aluminum flake comprises approximately 19 percent by weight, the calcium carbonate comprises approximately 4.5 percent by weight, and the gum arabic comprises approximately 5 percent by weight.

9. The lead-free pyrotechnic composition of claim 3, wherein the iodine pentoxide comprises a mesh size from about 20 to about 200.

10. The lead-free pyrotechnic composition of claim 9, wherein the iodine pentoxide comprises approximately 75.2 percent by weight, the aluminum comprises approximately 20 percent by weight aluminum flake, and the stabilizer comprises approximately 4.8 percent by weight calcium carbonate.

11. The lead-free pyrotechnic composition of claim 2, wherein the iodine pentoxide comprises approximately 80 percent by weight and the aluminum comprises approximately 20 percent by weight.

12. The lead-free pyrotechnic composition of claim 11, wherein the aluminum comprises aluminum flake having a size of from about 20 nanometers to about 40 nanometers.

13. The lead-free pyrotechnic composition of claim 1, further comprising from about 5 percent by weight to about 15 percent by weight of a coloring agent.

14. The lead-free pyrotechnic composition of claim 13, wherein the iodine pentoxide and the solid-powder fuel comprise a ratio of about 3 to about 1.

15. The lead-free pyrotechnic composition of claim 14, wherein the coloring agent may be selected from strontium carbonate, calcium carbonate, or barium carbonate.

16. A lead-free percussion primer composition, comprising:

from about 60 percent by weight to about 80 percent by weight iodine pentoxide;

from about 15 percent by weight to about 35 percent by weight alumimum flake comprising a size of from about 20 nanometers to about 100 nanometers;

from about 4 percent by weight to about 10 percent by weight of a stabilizer to nuetralize iodic acid formed from firing the composition; and, comprising from about 3 percent by weight to about 5 percent by weight of a binder.

17. A pyrotechnic flare composition, comprising:

from about 60 percent by weight to about 80 percent by weight iodine pentoxide;

from about 15 percent by weight to about 35 percent by weight of a solid-powder fuel comprising a size of from about 20 nanometers to about 100 nanometers and selected from alumimum, magnesium, or combinations thereof wherein the iodine pentoxide and the solid-powder fuel comprise a ration of about 3 to 1; and, from about 5 percent by weight to about 15 percent by weight of a coloring agent.

* * * * *